United States Patent [19]

Banzhaf et al.

[11] Patent Number: 4,801,095

[45] Date of Patent: Jan. 31, 1989

[54] FUEL INJECTION NOZZLE FOR INTERNAL COMBUSTION ENGINES

[75] Inventors: Werner Banzhaf, Sindelfingen; Ewald Eblen; Heinrich Faber, both of Stuttgart; Rolf J. Giersch, Eberdingen-Hochdorf; Karl Hofmann, Remseck; Dieter Liedtke, Ludwigsburg; Helmut Norberg, Stuttgart, all of Fed. Rep. of Germany

[73] Assignee: Robert Bosch GmbH, Stuttgart, Fed. Rep. of Germany

[21] Appl. No.: 35,584

[22] PCT Filed: Apr. 11, 1986

[86] PCT No.: PCT/DE86/00159

§ 371 Date: Dec. 15, 1986

§ 102(e) Date: Dec. 15, 1986

[87] PCT Pub. No.: WO87/00889

PCT Pub. Date: Feb. 12, 1987

[30] Foreign Application Priority Data

Aug. 10, 1985 [DE] Fed. Rep. of Germany ..... 3528792
Oct. 12, 1985 [DE] Fed. Rep. of Germany ..... 3536452

[51] Int. Cl.[4] ..... B21K 1/20
[52] U.S. Cl. ..... 239/533.3; 29/156.7 A
[58] Field of Search ..... 239/533.2–533.12, 239/585, 591; 29/157 C, 156.7 A, 156.7 R

[56] References Cited

U.S. PATENT DOCUMENTS 1,775,358 9/1930 Smith ..... 29/156.7 R
1,956,014 4/1934 Fink et al. ..... 29/156.7 R
1,979,910 11/1934 Scott ..... 29/156.7 A X
2,138,528 11/1938 Phillipps ..... 29/156.7 R
3,836,080 9/1974 Butterfield et al. ..... 239/533.4 X
4,035,204 7/1977 Hech et al. ..... 148/319 X
4,639,568 1/1987 Check et al. ..... 234/533.3 X
4,651,926 3/1981 Sasao et al. ..... 29/157 C X

FOREIGN PATENT DOCUMENTS 58-88459 5/1983 Japan ..... 239/533.2
59-43964 3/1984 Japan ..... 239/533.2

*Primary Examiner*—Douglas C. Butler
*Assistant Examiner*—Kevin P. Weldon
*Attorney, Agent, or Firm*—Michael J. Striker

[57] ABSTRACT

Fuel injection nozzle for internal combustion engines includes a nozzle element having a front cusp formed with a conical valve seat face. At least one injection hole is provided in the front cusp. The outer wall area of the front cusp which is disposed opposite to the valve seat face has a lower hardness than that of the inner wall area forming the valve seat face. When the injection hole extends from a pocket hole, preferably the outer wall area of the front cusp encompassing the picket hole has a lower hardness than that of the opposite disposed inner wall area. The intermediary center wall area preferably has a still lower hardness than the outer wall area. Thus, it is achieved that the front cusp of the nozzle element has a higher rigidity than in a known embodiment, without the valve seat face losing any hardness or that the protection of the outer wall area of the front cusp being unduly severly reduced against abrasive wear.

6 Claims, 1 Drawing Sheet

FUEL INJECTION NOZZLE FOR INTERNAL COMBUSTION ENGINES

BACKGROUND OF THE INVENTION

The invention relates to a fuel-injection nozzle for internal combustion engines. In these injection nozzles the front cusp of the nozzle element is hardened, so that the inside positioned valve seat face withstands the impact stress by the valve needle and the outside positioned wall area is protected against abrasive wear by the gas flow in the combustion chamber. However, it is disadvantageous in that the breaking rigidity of the front cusp of the nozzle element is reduced due to this wear and due to the presence of the injection holes in the area of the valve seat face or in the region of a pocket hole which is provided adjacent to the valve seat face. This disadvantage can only be partially overcome by a corresponding dimensioning of the wall thickness of the front cusp, because also the length of the injection holes and thereby the injection nozzle formation is decisively influenced. The cross section and the length of the injection holes are fixed in tight limitations due to such injection characteristic values, like amount of injection fuel spraying and the like.

SUMMARY OF THE INVENTION

It is an object of the present invention to provide a fuel injection nozzle in which the front cusp of the nozzle element may have a higher break resistance than that in the known embodiments, without the valve seat face losing any hardness and without the protection of the outer wall area of the front cusp being unduly severly reduced against abrasive wear.

One embodiment has been shown to be particularly advantageous by means of tests, wherein the hardness of an outer wall area of the front cusp is lower by at least 100 HV1, preferably by 150 HV1 than the hardness of the inner wall area forming the valve seat face.

The rigidity of the front cusp may be effectively increased without any impairment of the other characteristics of the front cusp if, in accordance with the invention, the center wall area of the front cusp which is disposed between the valve seat face or the pocket hole surface and the opposite disposed wall area has a lower hardness than the outer wall area. Particularly good results are obtained with injection nozzles, wherein the hardness of the center wall area is lower by at least 100 HV1 than the hardness of the outer wall area. It has been shown to be optimal if the hardness of the center wall area is between 400 HV1 and 550 HV1.

Generally, the nozzle elements of injection nozzles are made from carburized steel which for the purpose of a high hardness is recarburized. The reduced hardness of the outer wall area of the front cusp being disposed opposite of the valve seat face or the pocket hole surface can be obtained in that the front cusp is not recarbonized on the outside or only slightly recarbonized, so that in the carbonized hardened state a sufficient flexible form changing characteristics is obtained on the outside of the cusp. Comparison tests have shown that the rigidity characteristics of the front cusp can thereby be already noticeably increased. The same success can be obtained if, instead of the carbonizing, a nitrifying or nitrocarbonization is performed, whereby other steels than carburized steels may be used, preferably alloyed heat-treatable steels or steals which are worked at red heat. In this case it is advantageous to anneal the nozzle before the nitrifying.

An additional reduction of the hardness in the center area with respect to the customary manufacturing results in a further improvement. This can advantageously be obtained in that the wall thickness of the front cusp is at first selected larger than the finished size and that only after the recarburization or nitrifying or nitrocarburizing of the inner and outer wall areas of the front cusp the finished size is obtained by deburring a partial layer of the recarburized or nitrified or nitrocarburized outer wall area and thereafter a hardening or in the case of the nitrifying or nitrocarburizing a second nitrifying or nitrocarburization is performed, if need be.

The break resistance of the front cusp can be further increased if the injection holes are bored after the recarburization or the nitrifying or nitrocarburization or only after the hardening process and when the input edges of the injection holes are more severely rounded off.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
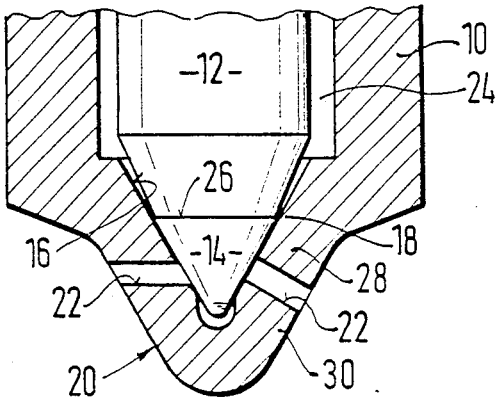
FIG. 1 illustrates a longitudinal section through the end section on the injection side of the first exemplified embodiment at a scale of about 1:10.

The injection nozzle in accordance with FIG. 1 has a nozzle element 10 in which a valve needle 12 is displaceably mounted. This valve needle has a conical sealing surface 14 which cooperates with a conical valve seat face 16 which is formed on an inner wall area 18 of a front cusp 20 of the nozzle element 10. A plurality of nozzle holes 22 extend from the valve seat face 16 which penetrate the wall of the front cusp 20 at an angle with respect to the nozzle axis of the nozzle.

An annular space 24 is formed between the valve needle 12 and a cylindrical inner wall of the nozzle element 10, wherein a fuel feeding line discharges, not illustrated. The valve needle 12 is pushed against the valve seat face 16 by a locking spring, also not illustrated. When the fuel pressure has increased in the annular space 24 to a predetermined value, the valve needle 12 is lifted against the force of the locking spring and the fuel is injected through the injection holes 22. The conical angle of the sealing face 14 on valve needle 12 may be selected somewhat greater than the angle of the valve seat face 16 so that at the beginning the highest sealing pressure force results at the upper edge 26 of the sealing face 14.

During the operation of the injection nozzle the valve seat face 16 is very highly stressed. Therefore, the inner wall area 18 of front cusp 20 containing the valve seat face 16 is treated by a customary process in such a manner that it has a hardness of about 750 HV1. When the valve needle 12 impacts on the front cusp 20 considerable radial forces are generated which exert an explosive action on the front cusp 20. These forces can only be taken into consideration in a limited manner by a corresponding dimensioning of the wall thickness of front cusp 20, because in this manner also the length of the injection holes 22 are influenced which in turn must be coordinated with other characteristic magnitudes of the injection process, like the shape of the injection, injection pressure, amount of injection etc.

Figure 2:
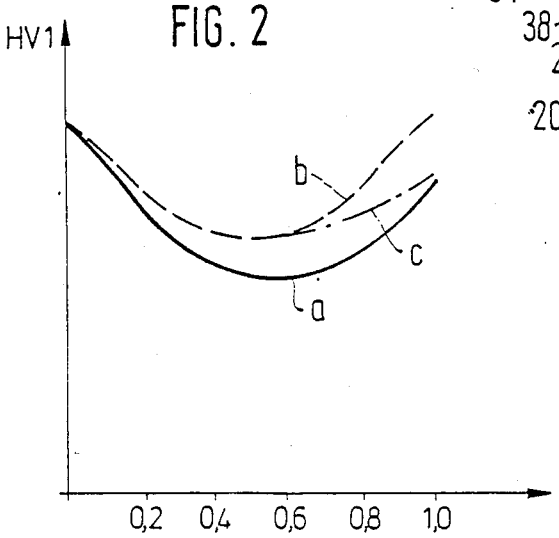
FIG. 2 illustrates the hardening curve transversely through the cusp wall of the nozzle element of the injection nozzle in accordance with FIG. 1.

In order to increase the breaking resistance of the front cusp 20, the center wall area 28 and the outer wall area 30 of the front cusp 20 are provided with a lower hardness than the inner area 18, in accordance with the invention. The hardening curve along a cross sectional line through the front cusp 20 is illustrated with a full line a in FIG. 2, whereby on the abscissa the distance from the valve seat 16 is shown and on the ordinate the hardness in HV1. For a comparison with the hardening curve a, in accordance with the invention, the hardening curve of a customary nozzle is also shown by a dotted line b in FIG. 2.

In the exemplified embodiment in accordance with FIG. 1, the hardness in the center area 28 is lowered to about 470 HV1 and increases again in the outer wall area 30 to about 600 HV1. Comparison tests have shown that the injection nozzle in accordance with the invention has an increased permanent rigidity due to the substantially reduced hardness in the outer wall area than a customary injection nozzle and can therefore be subjected to a higher stress than of a customary injection nozzle.

For example, as a base part for the hardening a nozzle element had been used consisting of a carburized steel which had not yet been provided with injection holes 22 and whose front cusp 20 had a wall thickness which was higher by a defined amount than the finished size. After the carburizing and hardening the injection holes 22 were worked in the front cusp 20 and by deburring of the excess material on the outer surfaces they were brought to the specified wall thickness of the remaining outer wall area 30 which is of lower hardness than the hardness of the inner wall area 18.

A further possibility of making a nozzle element consists in that the injection holes are bored with an enlarged wall thickness and after the recarburizing or nitrifying or nitrocarburizing the outer side of the cusp and thereby the carburized layer is milled off of ground off or the nitrifyed or nitrocarburized layer. With this process the injection holes are continuously hardened.

A further possibility to reduce the hardness of the outer wall area 30 of the front cusp 20 with respect to the inner wall area 18 consists, as already mentioned before, in that the front cusp already has the finished size during the recarburizing or nitrifying or nitrocarburizing and hardening, and that the outer wall area 30 is not or only slightly recarburized or nitrified or nitrocarburiZed. Thereby, a hardening curve may be obtained, when seen from the inside to the outside, following at first the customary curve b and thereafter the dotted line c in FIG. 2.

Figure 3:
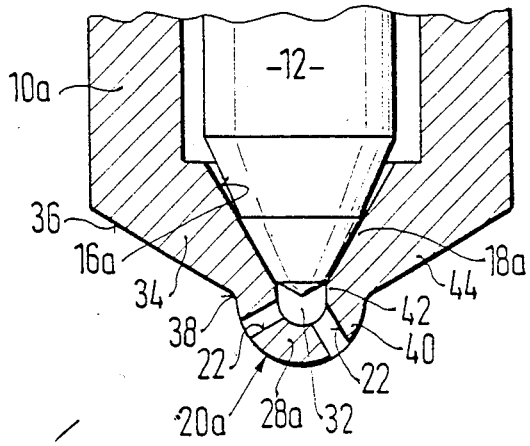
FIG. 3 illustrates the second exemplified embodiment in an illustration corresponding to FIG. 1.

The exemplified embodiment in accordance with FIG. 3 differs from the one in FIG. 1, of that the injection holes 22 do not extend from the valve seat face, but from a pocket hole 32 formed in the front cusp **20*a*. The nozzle element 10*a* is provided with a transition portion 34 between the front cusp 20*a* and the shaft, which on the outside is limited by a cone shaped peripheral face 36. This cone shaped jacket face changes over at a groove radius 36 into an outer wall area 40 of the front cusp 20*a* which is disposed opposite an inner wall area 42 being encompassed by the pocket hole 32**.

In the embodiment in accordance with FIG. 3, the outer wall area 44 being limited by the cone shaped peripheral face 36 and the groove radius 38 and the outer wall area 40 of the front cusp **20*a* being disposed opposite to the pocket hole 32 are provided with a lower hardness than that of the inner wall area 18*a* which forms the valve seat and the inner wall face 42 encompassing the pocket hole 32. The center wall area 28*a* of the front cusp 20*a* may advantageously have a lower hardness than that of the outer wall areas 40,44** in the same manner as in the first exemplified embodiment.

It will be understood that each of the elements described above, or two or more together, may also find a useful application in other types of fuel injection nozzles for internal combustion engines differing from the types described above.

While the invention has been illustrated and described as embodied in a fuel injection nozzle for internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a fuel injection nozzle for internal combustion engines, comprising a nozzle element, and a valve needle displaceably supported in said nozzle element and having a conical sealing surface, said nozzle element including a front cusp having an inner wall having an area which forms a conical valve seat face with which said sealing surface of said needle cooperates, said front cusp being provided with at least one injection hole and at least one outer wall area which has a lower hardness than that of said inner wall face which forms said valve seat, the improvement comprising said area of said inner wall face which forms said valve seat face being edge layer hardened to provide a greater hardness thereof, said front cusp having a center wall area (28 or **28*a*) which is disposed between the valve seat face (16 or 16*a*) and an outer wall area (30 or 44) of said nozzle element, which opposite to said valve seat face, said center wall area having a lower hardness than that of the outer wall area (30 or 40, 44**).

2. Injection nozzle as defined in claim 1, wherein the hardness of the one outer wall area (30 or 40, 44) of the front cusp (**20, 20*a*) is lower by at least 100 HVL than the hardness of the area of said inner wall (18, 18*a*) forming the valve seat face (16, 16*a***).

3. Injection nozzle as defined in claim 2, wherein the hardness of the one outer wall area (30 or 40, 44) of the front cusp (**20, 20*a*) is lower by at least 150 HVL than the hardness of the area of said inner wall (18, 18*a*) forming the valve seat face (16, 16*a***).

4. Injection nozzle as defined in claim 1, wherein the hardness of the center wall area (28 or **28*a*) of the front cusp (20 or 20*a*) is lower by at least 100 HV1 than the hardness of said outer wall area (30 or 40, 44**).

5. Injection nozzle as defined in claim 1, wherein the hardness of the center wall area (28 or 28*a*) of the front cusp (20 or 20*a*) is between 400 HV1 and 550 HV1.

6. Injection nozzle as defined in claim 1, and having a pocket hole adjacent to the valve seat face, said at least one injection hole extending outwardly from said pocket hole, said pocket being encompassed with a portion of the inner wall of said front cusp, said portion being edge layer hardened.

* * * * *